United States Patent [19]

Akechi et al.

[11] Patent Number: 4,722,751

[45] Date of Patent: Feb. 2, 1988

[54] DISPERSION-STRENGTHENED HEAT- AND WEAR-RESISTANT ALUMINUM ALLOY AND PROCESS FOR PRODUCING SAME

[75] Inventors: Kiyoaki Akechi; Nobuhito Kuroishi, both of Itami, Japan

[73] Assignee: Sumitomo Electric Industries, Ltd., Osaka, Japan

[21] Appl. No.: 683,454

[22] Filed: Dec. 19, 1984

[30] Foreign Application Priority Data

Dec. 19, 1983 [JP] Japan ..... 58-240295
Dec. 19, 1983 [JP] Japan ..... 58-240296

[51] Int. Cl.[4] ..... C22C 29/02; C22C 29/06; C22C 29/12; C22C 29/16

[52] U.S. Cl. ..... 75/232; 75/233; 75/234; 75/235; 75/236; 75/237; 75/241; 75/243; 75/244; 419/32; 419/38; 419/42

[58] Field of Search ..... 75/231, 232, 235, 236, 75/244, 249, 234, 237, 241, 243; 420/548, 550; 419/38, 41, 42, 43, 49, 50, 32

[56] References Cited

U.S. PATENT DOCUMENTS

| | | | |
|---|---|---|---|
| 2,974,039 | 3/1961 | Deventer et al. | 75/249 |
| 3,791,800 | 2/1974 | McGee | 75/249 |
| 3,816,080 | 6/1974 | Bomford et al. | 75/249 |
| 3,961,945 | 6/1976 | Sanders et al. | 75/249 |
| 4,156,053 | 5/1979 | Baranow | 428/570 |

FOREIGN PATENT DOCUMENTS

| | | | |
|---|---|---|---|
| 60/50137 | 3/1985 | Japan | 75/249 |
| 2088409 | 6/1982 | United Kingdom | 75/249 |

*Primary Examiner*—John F. Terapane
*Assistant Examiner*—Eric Jorgensen
*Attorney, Agent, or Firm*—Cushman, Darby & Cushman

[57] ABSTRACT

A light weight and high strength aluminum alloy and a process for producing such an alloy, which alloy is suitable for forming automotive engine components, including pistons. In a preferred embodiment, 80 to 99.5% by volume of an aluminum alloy powder or a mixed powder composed of pure metal powders or master alloy powders is blended with 0.5 to 20% by volume of at least one of carbon or graphite powder, an oxide powder, a carbide powder and a nitride powder. The blend is then mechanically alloyed, following which the thereby-obtained powder is subjected to working such as by compaction and hot forging, hot pressing, cold isostatic pressing and hot forging, or cold isostatic pressing and hot extrusion. By the use of mechanical alloying, the advantages of a rapidly solidified powder having a supersaturated solid solution and uniform fine crystal grains are attained, and the effect of dispersion-strengthening is brought about by the addition of dispersion particles to the micro structure of the rapidly solidified powder.

15 Claims, 2 Drawing Figures

DISPERSION-STRENGTHENED HEAT- AND WEAR-RESISTANT ALUMINUM ALLOY AND PROCESS FOR PRODUCING SAME

BACKGROUND OF THE INVENTION

The present invention relates to a lightweight and high strength aluminum alloy having excellent resistance to heat and wear, particularly, to an aluminum alloy that can withstand use under extreme conditions. The invention also relates to a process for producing such an aluminum alloy.

Aluminum alloys are lightweight and resistant to corrosion. However, because of their low melting points, aluminum alloys have the inherent disadvantage of poor strength at elevated temperatures. Development efforts have been made to produce a heat- and wear-resistant aluminum alloy having a uniform structure of finely precipitated and crystallized grains by hot working a rapidly solidified aluminum alloy powder that permits alloy designs without limitation by the phase diagram. However, the technique of freezing a non-equilibrium phase by by rapid solidification presents problems in the subsequent and associated heating step in hot working. If the rapidly solidified alloy powder is heated for a certain period at a temperature suitable for hot working, the nonequilibrium phase converts to an equilibrium phase or the crystal grains grow to an unacceptably large size, thereby making it difficult to obtain a starting alloy that retains the microscopic features of the initial rapidly solidified powder. A material is necessary that can be softened during hot working but which exhibits an extremely high strength below that softening point.

With the recent demand for automotive engines and aircraft engines that perform better with less energy consumption, efforts are being made to reduce their size and weight while increasing the power output. In order to attain this object, materials used in pistons and other engine parts must be capable of withstanding very hostile conditions with respect to load and temperature.

Conventional pistons for automotive engines are cast from JIS AC8B and other Al-Si base alloys. However, alloys having a Si content of 20% or more have problems of segregation and coarsening of primary crystals (hypereutectics). It is not possible to produce castings adapted for service under high load and temperature conditions from such alloys having a Si content of 20% or more. In order to overcome these problems, considerable effort has been made to produce a high-temperature and wear-resistant aluminum alloy material which is pore-free and which contains uniform fine crystal grains by extruding or otherwise working a rapidly solidified high-Si aluminum alloy powder. However, the use of rapidly solidified powders requires careful selection of the fabrication method in order to avoid coarsening of grains due to hot-forming in the densification step. Furthermore, much technical difficulty is involved in adding dispersion particles to the rapidly solidified powder. In other words, heretofore, there has been no success in providing an advanced high-temperature and wear-resistant aluminum alloy simply by means of dispersion strengthening based on rapid solidification techniques.

SUMMARY OF THE INVENTION

Accordingly, the present invention provides a solution to problems previously associated with conventional techniques. In order to meet the above-mentioned requirements, the present invention employs a combination of mechanical alloying techniques with alloying, the addition of dispersion particles for providing a dispersion-strengthened heat- and wear-resistant aluminum alloy. By the mechanical alloying technique, the advantages of a rapidly solidified powder having a supersaturated solid solution and uniform fine crystal grains are retained, or similar advantages are obtained by subjecting a mixed powder to mechanical alloying. On the other hand, the effect of dispersion strengthening is brought about by the addition of dispersion particles to the microstructure of the rapidly solidified powder. The resulting product has a greater resistance to heat and wear than conventional ingot metallurgical products, even greater than recently developed materials prepared from rapidly solidified powders.

DESCRIPTION OF THE PREFERRED EMBODIMENTS

Figure 1:
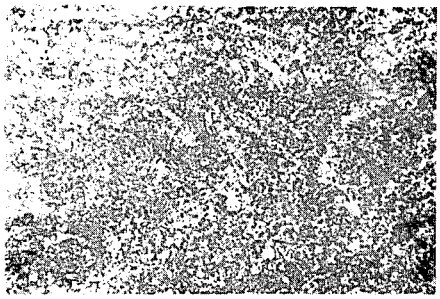
FIG. 1 is a micrograph (X 400) of the mechanical alloyed composite powder from which a sample No. 1 shown in Table 1 was prepared.

A dispersion-strengthened heat- and wear-resistant aluminum alloy material of the present invention is produced by first blending heat-resistant particles with a rapidly solidified aluminum alloy powder, pure metal powders or master alloy powders, then forming a composite powder from the milling by a mechanical alloying technique, and finally subjecting the composite powder to working such as compaction and sinter forging, cold isostatic pressing and hot forging, hot pressing, or cold isostatic pressing and hot extrusion.

The present invention has been accomplished based on the finding that an aluminum alloy having a significantly improved heat resistance without sacrificing high wear resistance can be produced by combining the effect of fine crystal grains in a rapidly solidified powder in the strengthening of the matrix with the effect of mechanical alloying in dispersion strengthening due to dispersed $Al_4C_3$ particles.

The aluminum alloy of the present invention will hereunder be described in greater detail.

The heat-resistant particles are made of various oxides, carbides or nitrides, which may be used individually or in combination, with the mixing ratio of the heat-resistant particles (ceramics particles) being 0.5 to 20% by volume. A carbon powder (or graphite powder) is partly converted to a carbide ($Al_4C_3$) in the composite powder obtained by mechanical alloying, and is entirely converted to such carbide ($Al_4C_3$) after hot working. Therefore, the carbide added as the heat-resistant particles may include a carbon powder (or graphite powder).

A powder containing more than 20% by volume of the heat-resistant particles can be mechanically alloyed, but it involves considerable difficulty in the subsequent working. Furthermore, the final aluminum alloy is very brittle. In order to provide their dispersion strengthening effect, the heat-resistant particles must be added in an amount of at least 0.5% by volume.

The rapidly solidified aluminum alloy powder is desirably obtained by cooling at a rate of $10^2$°C./sec or faster; more, specifically, a gas atomized powder that passes through 60 mesh is desired. Coarser grains may be employed in view of the subsequent mechanical alloying step, but they are deleterious to the uniformity of the final alloy composition.

High Si rapidly solidified aluminum powders have recently been developed as heat- and wear-resistant aluminum alloys, which powders have a composition of 5 to 30% Si, 0 to 5% Cu, 0 to 2% Mg and the balance Al, with the percentages being on a weight basis. Considerable work has also done in developing Al-Fe base rapidly solidified alloys having a composition of 2 to 12% Fe, 0 to 7% of at least one transition metal such as Co, Ni, Cr, Mn, Ce, Ti, Zr or Mo, and the balance Al, these percentages also being on a weight basis. One feature of the present invention is the use of such rapidly solidified aluminum alloy powders. According to another feature of the present invention, a composition which is the same as those of such rapidly solidified powders may be achieved by a mixture of pure metal powders, a mixture of master alloy powders and pure metal powders, or a mixture of two or more master alloy powders.

Working examples of the present invention are given below.

EXAMPLE 1

The aluminum alloy powders and heat-resistant particles shown in Table 1 were blended in a volume ratio of 95:5, and the blends were subjected to mechanical alloying in a dry attritor (200 rpm) for 4 hours. A micrograph of one of the resulting composite powders is shown in FIG. 1. The respective composite powders were subjected to cold isostatic pressing at 4 tons/cm$^2$, heated in the atmosphere at 500° C. for 2 hrs, and hot-extruded at a plane pressure of 9.5 tons/cm$^2$ and a extrusion ratio of 10/1. The properties of each of the extruded aluminum alloys are listed in Table 2. The improvement in the tensile strengths at room temperature of the samples was not significant, but the improvement in the tensile strength at elevated temperature (300° C.) was appreciable.

TABLE 1

| Sample No. | Aluminum alloy powder (all powders were under 100 mesh) | Heat-resistant particles |
|---|---|---|
| 1 | atomized Al—17% Si—4% Cu—1% Mg powder | $Al_2O_3$ (~0.4 μm) |
| 2 | atomized Al—17% Si—4% Cu—1% Mg powder | SiC (~4 μm) |
| 3 | atomized Al—17% Si—4% Cu—1% Mg powder | $Si_3N_4$ (~1 μm) |
| 4 | atomized Al—8% Fe—2% Co powder | $Al_2O_3$ (~0.4 μm) |
| 5 | Atomized Al—8% Fe—2% Co powder | SiC (~4 μm) |
| 6 | Atomized Al—8% Fe—2% Co powder | carbon black (0.1 μm) + $Al_2O_3$ (~0.4 μm) |
| 7 | mixture of 50 wt % of atomized Al—17% Si—4% Cu—1% Mg powder and 50 wt % of atomized Al—8% Fe—2% Co powder | $Al_2O_3$ (~0.4 μm) |
| 8 | mixture of 96 wt % of atomized Al—17% Si—1% Mg powder and 4 wt % of pure Cu powder | $Al_2O_3$ (~0.4 μm) |

TABLE 2

| Sample No. | Density, g/cm$^3$ | Rockwell hardness (scale B) | Tensile strength, kg/mm$^2$ RT | Tensile strength, kg/mm$^2$ 300° C. |
|---|---|---|---|---|
| 1 | 2.70 | 78 | 51 | 27 |
| 2 | 2.70 | 77 | 50 | 29 |
| 3 | 2.72 | 80 | 52 | 28 |
| 4 | 2.83 | 86 | 43 | 31 |
| 5 | 2.84 | 85 | 47 | 33 |
| 6 | 2.77 | 75 | 56 | 35 |
| 7 | 2.75 | 82 | 52 | 30 |
| 8 | 2.71 | 73 | 48 | 24 |
| Comparative Sample* | A 2.69 | 70 | 49 | 11 |
| | B 2.81 | 82 | 38 | 25 |

*Comparative sample
A: Al—17% Si—4% Cu—1% Mg
B: Al—8% Fe—2% Co

Furthermore, carbon (graphite) powder can be used as dispersion particles according to the present invention. In this case, the present invention can be accomplished by first mechanically alloying a mixture of 90 to 99.5 vol% of rapidly solidified aluminum powder and 0.5 to 10 vol% of carbon (graphite) powder, and then subjecting the resulting powder to a forming technique such as compaction and sintering, hot pressing, powder forging, powder rolling, hot isostatic pressing or hot extrusion.

Properties similar to those of the rapidly solidified aluminum alloy powder can be obtained by the mechanical alloying of a blend of carbon (graphite) powder and a mixed powder having the same composition as that of the rapidly solidified aluminum alloy powder. During mechanical alloying, subsequent heating which is effected prior to shaping, and during the heat treatment of the shaped article, the initial carbon (graphite) converts to a carbide ($Al_4C_3$) which is finely dispersed in the master alloy to provide a strong alloy product.

The rapidly solidified Al-Si base alloy powder or the mixed powder used as one component of the blend to be mechanically alloyed in this embodiment has a Si content in the range of 5 to 30% by weight. An alloy having less than 5% by weight of Si can be easily produced even by casting, but the resulting product has a low wear resistance. A Si content exceeding 45% by weight is favorable to high wear resistance, but, on the other hand, difficulty occurs in hot-forming the powder and in the subsequent plastic working.

Cu and Mg are optional elements; Cu is added for its precipitation-strengthening action due to the heat treatment of the alloy, and Mg for its solid solution-strengthening action. Their addition may be omitted if the strength at room temperature is not important.

The volume fraction of the carbon powder (graphite powder) that converts to carbide ($Al_4C_3$) particles by the subsequent mechanical alloying or hot working is limited to the range of 0.5 to 10%. If the volume fraction of the carbon (graphite) powder is less than 0.5%, it has no dispersion strengthening action, and if it is present in an amount exceeding 10% by volume, a brittle powder results after mechanical alloying, and great difficulty is involved in the subsequent hot working or in the plastic working of the alloy product.

The rapidly solidified Al-Fe base alloy powder or the mixed powder should have an Fe content of 2 to 12% by weight. A powder with an Fe content of less than 2% by weight is not effective in providing improved heat and wear resistance. If the Fe content exceeds 12% by weight, the mechanically alloyed powder does not have good hot workability and the final alloy is also poor in plastic workability. The addition of a transition metal such as Co, Ni, Cr, Mn, Ce, Ti, Zr or Mo is desired for achieving further improvements in the alloy characteristics and the formability or workability of the powder. However, the addition of these transition metals is not critical for the purpose of the present invention. There is no technical problem at all with adding the transition metal in an amount greater than 7% by weight (which may even exceed the Fe content). However, for economic reasons, it is preferred that the maximum amount of the transition metal be limited to 7% by weight.

The idea of mechanical alloying the rapidly solidified Al-Si-Fe base alloy powder or the mixed powder together with the carbon powder (graphite powder) is based on the finding that, by so doing, the advantages of two alloy systems, Al-Si and Al-Fe, can be obtained simultaneously. A mechanically alloyed powder from a composition containing 10 to 14 wt% Si and 4 to 6 wt% Fe has extremely good hot workability and is capable of suppressing high thermal expansion, a defect common to all Al alloys. Therefore, the aluminum alloy prepared from the above composition has the advantage of low thermal expansion in addition to high temperature and wear resistance.

Depending on the alloy composition, the particles of the aluminum powder may agglomerate before they are mechanically alloyed completely and uniformly. This phenomenon usually does not occur with a rapidly solidified powder of high hardness, but is likely to occur in the mechanical alloying of a powder mix with pure aluminum powder or other pure metal powders. If such agglomeration is expected, water, oil or an organic solvent must be added in a suitable amount (0.05 to 3% by volume) so that agglomeration is avoided and sufficient mechanical alloying is ensured. The added water, oil or organic solvent is released by the heating or degasification of the mechanically alloyed powder before hot working or the shaped article of that powder. Alternatively, water, oil or organic solvent can be dispersed as the carbide $Al_4C_3$.

EXAMPLE 2

Figure 2:
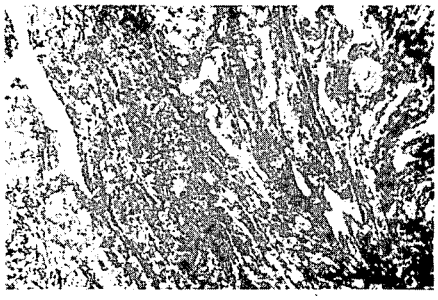
FIG. 2 is a micrograph (X 400) of a powder prepared by mechanical alloying in Example 2 of the present invention.

A rapidly solidified aluminum alloy powder (100 mesh, Al-12%Si-5%Fe-4.5%Cu-1%Mg) prepared by gas atomization was blended with a carbon powder (carbon black) in a volume ratio of 97:3, and the blend was mechanically alloyed in a dry attritor for 5 hours. The particles in the powder blend agglomerated to an average size of about 1 mm, and had a wavy structure characteristic of a mechanically alloyed powder (see FIG. 2). No primary crystals of Si were observed. The powder had a micro Vickers hardness exceeding 250.

The powder was placed in an aluminum sheath, heated at 450° C. for 2 hrs. and hot-extruded at a extrusion ratio of 10/1. The properties of the extruded alloy are shown in Table 3 below. The alloy had such a fine structure that the individual grains could not be recognized with an optical microscope at a magnification of about 1000. The tensile strength of the alloy was greater than 30 kg/mm$^2$ at 300° C. The alloy also had a low thermal expansion coefficient.

TABLE 3

| | |
|---|---|
| Density | 2.69 g/cm$^3$ |
| Rockwell hardness (scale B) | 84 |
| Tensile strength (RT) | 55 kg/mm$^2$ |
| Tensile strength (300° C.) | 32 kg/mm$^2$ |
| Elongation (RT) | 7% |
| Elongation (300° C.) | 10% |
| Thermal expansion coefficient (averaged for the range of RT to 300° C.) | $16.0 \times 10^{-6}$/°C. |
| Heat conductivity | 0.36 Cal/°C. sec cm |

EXAMPLE 3

Rapidly solidified powders or mixed powders having the compositions shown in Table 4 were mixed with carbon powder (carbon black) or graphite powder, and the blends were mechanically alloyed in a dry ball mill for 10 days. The powders were shaped with a cold isostatic press at 4 tons/cm$^2$, heated at 450° C. for 2 hours and finally hot-extruded. The density, Rockwell hardness (scale B) and the tensile strength at room temperature and 300° C. of each resulting alloy are listed in Table 5. All products had excellent strength properties at high temperature. The data shows that, by the mechanical alloying of the rapidly solidified aluminum alloy powder or mixed powder together with carbon powder or graphite powder, products whose tensile strengths at 300° C. are at least 10 kg/mm$^2$ higher than that of an alloy made from only the rapidly solidified powder can be produced.

TABLE 4

| Sample No. | Al—base powder | Volume fraction | Particles to be dispersed | Volume fraction |
|---|---|---|---|---|
| 1 | gas atomized Al—17% Si—4% Cu—1% Mg powder (100 mesh) | 98 | carbon black powder (average particle size 1 μm) | 2 |
| 2 | gas atomized Al—8% Fe—2% Co powder (100 mesh) | 98 | carbon black powder (average particle size 1 μm) | 2 |
| 3 | mixture of 50% gas atomized Al—17% Si—4% Cu—1% Mg powder (100 mesh) and 50% gas atomized Al—8% Fe—2% Co powder (100 mesh) | 98 | carbon black powder (average particle size 1 μm) | 2 |
| 4 | mixture of 40% Al powder 50% of Al—30% Si alloy powder, 8% Fe powder and 2% Co powder (100 mesh) | 98 | graphite powder (average size 3 μm) | 2 |
| 5 | mixture of 78% Al powder, | 96 | graphite | 4 |

TABLE 4-continued

| Sample No. | Al—base powder | Volume fraction | Particles to be dispersed | Volume fraction |
|---|---|---|---|---|
| | 12% Si powder, 5% Fe powder, 4% Cu powder and 1% Mg powder (100 mesh) | | powder (average size 3 μm) | |

TABLE 5

| Sample No. | Density at RT, g/cm$^3$ | Rockwell hardness (scale B) at RT | Tensile strength, kg/mm$^2$ RT | Tensile strength, kg/mm$^2$ 300° C. |
|---|---|---|---|---|
| 1 | 2.69 | 75 | 50 | 26 |
| 2 | 2.78 | 86 | 48 | 36 |
| 3 | 2.75 | 80 | 56 | 31 |
| 4 | 2.70 | 85 | 51 | 30 |
| 5 | 2.75 | 83 | 50 | 35 |

We claim:

1. A dispersion-strengthened heat-resistant and wear-resistant aluminum alloy produced by the process comprising the steps of:

blending 80% to 99.5% by volume of an aluminum-containing powder consisting essentially of a rapidly solidified aluminum alloy powder, a mixed powder consisting essentially of pure metal powders, or a master alloy powder with, 0.5 to 20% by volume of at least one component selected from the group consisting of carbon powder, graphite powder, silicon oxide powder, aluminum oxide powder, silicon carbide powder, aluminum carbide powder, silicon nitride powder, aluminum nitride powder and mixtures thereof, whereby a blend is obtained, mechanically alloying the thus obtained blend to obtain a powder, and subjecting the thus obtained powder to working whereby a dispersion-strengthened heat-resistant and wear-resistant aluminum alloy is obtained.

2. A dispersion-strengthened, heat-resistant and wear-resistant aluminum alloy according to claim 1, wherein said aluminum-containing powder is blended with 0.5 to 20% by volume of carbon powder or graphite powder.

3. The high temperature and wear-resistant aluminum alloy according to claim 2, wherein said step of working comprises at least one of compaction and sintering, hot pressing, P/M forging, powder rolling, hot isostatic pressing and hot extrusion molding.

4. The dispersion-strengthened, high-temperature and wear-resistant aluminum alloy according to claim 3, wherein the rapidly solidified aluminum containing powder consists of 5 to 45% Si, 0 to 5% Cu, 0 to 2% Mg, with the balance of said aluminum containing powder being on an Al, said percentages being on a weight basis.

5. The dispersion-strengthened, high-temperature and wear-resistant aluminum alloy according to claim 3, wherein the rapidly solidified aluminum-containing powder consists of 2 to 12% Fe, 0 to 7%, of at least one element selected from the group consisting of Co, Ni, Cr, Mn, Ce, Ti, Zr and Mo, with the balance of said aluminum-containing powder being Al, said percentages being on a weight basis.

6. The dispersion-strengthened, high-temperature and wear-resistant aluminum alloy according to claim 3, wherein the rapidly solidified aluminum-containing powder consists of 5 to 25% Si, 2 to 12% Fe, 0 to 5% Cu, 0 to 2% Mg, 0.7% of at least one element selected from the group consisting of Co, Ni, Cr, Mn, Ce, Ti, Zr and Mo, with the balance of said aluminum-containing alloy powder being Al, said percentages being on a weight basis.

7. The dispersion-strengthened, heat-resistant and wear-resistant aluminum alloy according to claim 1, wherein the aluminum-containing powder consists of 5% to 45% Si, 0% to 5% Cu, 0% to 2% Mg, with the remainder as said aluminum containing alloy powder being Al, said percentage as being on a weight basis.

8. The dispersion-strengthened heat-resistant and wear-resistant aluminum alloy according to claim 3, wherein said component is a carbon powder, graphite powder, a silicon oxide powder, and an aluminum carbide powder, a silicon carbide powder, an aluminum nitride powder, a silicon nitride powder, and mixtures thereof.

9. The dispersion-strengthened, heat-resistant and wear-resistant aluminum alloy according to claim 1, wherein the aluminum-containing powder consists of 2% to 12% Fe, 0% to 7% of at least one element selected from the group consisting of Co, Ni, Cr, Mn, Ce, Ti, Zr and Mo, with the balance of said aluminum-containing powder being aluminum, said percentages being on weight basis.

10. The dispersion-strengthened heat-resistant and wear-resistant aluminum alloy according to claim 9, wherein said component is a carbon powder, graphite powder, a silicon oxide powder, an aluminum carbide powder, a silicon carbide powder, an aluminum nitride powder, a silicon nitride powder, and mixtures thereof.

11. The dispersion-strengthened heat- and wear-resistant aluminum alloy according to claim 1, wherein said step of working comprises at least one of compaction and hot forging, hot pressing, cold isostatic pressing and hot forging, and cold isostatic pressing and hot extrusion.

12. The dispersion-strengthened heat-resistant and wear-resistant aluminum alloy according to claim 1, wherein said component is $Al_4C_3$.

13. The dispersion-strengthened heat-resistant and wear-resistant aluminum alloy according to claim 1, wherein said component is silicon carbide (SiC).

14. The dispersion-strengthened heat-resistant and wear-resistant aluminum alloy according to claim 1, wherein said component is silicon nitride ($Si_3N_4$).

15. The dispersion-strengthened heat-resistant and wear-resistant aluminum alloy according to claim 1, wherein said component is a carbon powder, graphite powder, a silicon oxide powder, an aluminum carbide powder, a silicon carbide powder, an aluminum nitride powder, a silicon nitride powder, and mixtures thereof.

* * * * *